US006991894B2

(12) United States Patent
Sakizadeh et al.

(10) Patent No.: US 6,991,894 B2
(45) Date of Patent: Jan. 31, 2006

(54) THERMALLY DEVELOPABLE IMAGING MATERIALS WITH BARRIER LAYER

(75) Inventors: Kumars Sakizadeh, Woodbury, MN (US); Karissa L. Eckert, Cottage Grove, MN (US); Gary E. LaBelle, Stillwater, MN (US); David R. Whitcomb, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 91 days.

(21) Appl. No.: 10/699,768

(22) Filed: Nov. 3, 2003

(65) Prior Publication Data

US 2005/0095540 A1 May 5, 2005

(51) Int. Cl.
*G03C 1/498* (2006.01)
*G03C 1/494* (2006.01)
*G03C 1/76* (2006.01)

(52) U.S. Cl. ..... 430/353; 430/523; 430/619; 430/620; 430/961

(58) Field of Classification Search ..... 430/353, 430/523, 961, 619, 620
See application file for complete search history.

(56) References Cited

U.S. PATENT DOCUMENTS 3,708,304 A * 1/1973 Hiller ..... 430/353
4,668,612 A 5/1987 Hirai et al.
4,880,723 A * 11/1989 Hirai et al. ..... 430/218
5,422,234 A 6/1995 Bauer et al.
5,989,796 A 11/1999 Moon
6,093,529 A 7/2000 Tsuzuki et al.
6,143,481 A 11/2000 Uytterhoeven et al.
6,350,561 B1 2/2002 Miller et al.
6,352,819 B1 3/2002 Kenney et al.
6,352,820 B1 3/2002 Bauer et al.
6,399,292 B2 6/2002 Fujiwara et al.
6,420,102 B1 7/2002 Bauer et al.
6,667,148 B1 * 12/2003 Rao et al. ..... 430/350
6,746,831 B1 * 6/2004 Hunt ..... 430/350

FOREIGN PATENT DOCUMENTS

JP 11-190894 7/1999

* cited by examiner

*Primary Examiner*—Richard L. Schilling
(74) *Attorney, Agent, or Firm*—J. Lanny Tucker; Louis M. Leichter

(57) ABSTRACT

Thermographic and photothermographic materials comprise a barrier layer to provide physical protection and to prevent migration of diffusible imaging components and by-products resulting from high temperature imaging and/or development. The barrier layer comprises a scavenger that is a metal hydroxide or ester. This barrier layer is capable of retarding diffusion of mobile chemicals such as organic carboxylic acids, developers, and toners.

28 Claims, No Drawings

THERMALLY DEVELOPABLE IMAGING MATERIALS WITH BARRIER LAYER

FIELD OF THE INVENTION

This invention relates to thermally developable imaging materials such as thermographic and photothermographic materials. More particularly, it relates to thermographic and photothermographic imaging materials having improved physical protection by the presence of a unique barrier layer containing a metal hydroxide or metal ester. The invention also relates to methods of imaging using these materials. This invention is directed to the photothermographic and thermographic imaging industries.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photosensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60° C. to about 225° C., resulting in the formation of an image.

Silver-containing photothermographic imaging materials are photosensitive materials that are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure, June* 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ," for example by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, 7–11 Sep. 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

As noted above, thermographic and photothermographic materials generally include a source of reducible silver ions for thermal development. The most common sources of reducible silver ions are the silver fatty acid carboxylates described above. Other components in such materials include a reducing agent system that usually includes a reducing agent, and optionally a toning agent (common ones being phthalazine and derivatives thereof).

We have found that by-products including various fatty carboxylic acids (such as behenic acid) are formed in thermographic and photothermographic materials during thermal development. These fatty acid by-products as well as the reducing agent and any toner that is present can readily diffuse out of the materials during thermal development and cause debris build-up on the thermal processing equipment (such as processor drums or thermal print-heads). This may result in the processed materials sticking to the processing equipment and causing a jam in the machine, as well as scratching of the outer surface of the developed materials. Additionally, cleaning of the machine to remove this debris can result in machine downtime, and increase the number of service calls.

It is known from U.S. Pat. No. 5,422,234 (Bauer et al.) and U.S. Pat. No. 5,989,796 (Moon) to use a surface overcoat layer comprising gelatin, poly(vinyl alcohol), poly (silicic acid), or combinations of such hydrophilic materials to minimize the problems in photothermographic materials noted above. These overcoat layer materials provide suitable barriers to diffusion of reagents from the photothermographic materials.

Useful barrier layer polymers including water-soluble polyesters are described in U.S. Pat. No. 6,352,819 (Kenney et al.). Additional useful film-forming barrier layer polymers are those having epoxy functionality as described in U.S. Pat. No. 6,350,561 (Miller et al.). Additional polyesters useful as barrier layers are described in U.S. Pat. No. 6,352,820 (Bauer et al.). Various overcoat materials are described in U.S. Pat. No. 6,143,481 (Uytterhoeven et al.) and U.S. Pat. No. 6,399,292 (Fujiwara et al.).

Still additional polymers useful as barrier layers are film-forming acrylic or methacrylic acid ester or amide polymer(s) comprising hydroxy functionality as described in U.S. Pat. No. 6,420,102 (Bauer et al.).

More recently, cellulose ether polymers have been used in barrier layers of thermographic and photothermographic materials as described in U.S. Pat. No. 6,746,831 (Hunt).

Polyvalent metal ions and phthalic acid are included in protective layers of the photothermographic materials of U.S. Pat. No. 6,093,529 (Tsuzuki et al.) allegedly to improve shelf stability and to provide blue-black toned images. The polyvalent metal ions can be provided in the form of organic salts. The photothermographic materials include binders that are predominantly polymeric latex polymers.

There remains a need for additional suitable barrier layer materials that provide physical protection while inhibiting the diffusion of various chemicals out of thermally developable materials during thermal development. It would be particularly desirable to have improved thermographic and photothermographic materials that include a layer that acts as a barrier to the diffusion of fatty acids, developers, toners, and other mobile chemicals from the materials during thermal development.

SUMMARY OF THE INVENTION

The present invention provides a black-and-white thermally developable material comprising a support having thereon:

a) one or more thermally developable imaging layers comprising a binder and in reactive association, a non-photosensitive source of reducible silver ions that includes at least a silver carboxylate, and a reducing agent composition for the non-photosensitive source of reducible silver ions, the binder comprising from 0 to less than 50% of a polymer latex based on total binder weight, and b) a barrier layer that is on the same side of but farther from the support than the one or more imaging layers, the barrier layer containing as a scavenger, a water-insoluble compound having the following Structure I:

$$M(X)_n \quad \text{(I)}$$

wherein M is a first row transition metal cation, X is a hydroxyl group, or an organic carboxylate having a molecular weight of from about 55 to about 500, and n is an integer representing the positive charge on M, wherein the amount of the scavenger being from about 0.1 to about 1 mole per mole of the silver carboxylate.

This invention also provides a black-and-white photothermographic material comprising a support having thereon:

a) one or more thermally developable imaging layers comprising a binder and in reactive association, a photosensitive silver halide, a non-photosensitive source of reducible silver ions that includes at least a silver carboxylate, and a reducing agent composition for the non-photosensitive source of reducible silver ions, the binder comprising from 0 to less than 50% of a polymer latex based on total binder weight, and b) a barrier layer that is on the same side of but farther from the support than the one or more imaging layers, the barrier layer containing as a scavenger, a water-insoluble compound having the Structure I:

$$M(X)_n \quad \text{(I)}$$

wherein M is a first row transition metal cation, X is a hydroxyl group, or an organic carboxylate having a molecular weight of from about 55 to about 500, and n is an integer representing the positive charge on M, wherein the amount of the scavenger being from about 0.1 to about 1 mole per mole of the silver carboxylate.

In preferred embodiments, the present invention comprises a black-and-white photothermographic material comprising a support having thereon:

a) one or more thermally developable imaging layers comprising a hydrophobic binder and in reactive association, a photosensitive preformed silver halide that is silver bromide, silver iodobromide having up to 10 mol % silver iodide, or a mixture of these silver halides, a non-photosensitive source of reducible silver ions comprising one or more silver fatty acid carboxylates that include silver behenate, and a reducing agent composition for the non-photosensitive source reducible silver ions comprising a hindered phenol, the binder comprising from 0 to less than 50% of a polymer latex based on total binder weight, and b) a barrier layer that is on the same side of but farther from the support than said one or more imaging layers, the barrier layer comprising a scavenger that is zinc acetate, zinc hydroxide, zinc acrylate, zinc methacrylate, zinc benzoate, nickel acetate, manganese acetate, or mixtures thereof, the scavenger present in an amount of from about 0.4 to about 0.6 mole per mole of the one or more silver fatty acid carboxylates, and the barrier layer having a dry thickness of from about 1.5 $\mu$m to about 3 $\mu$m.

Such preferred photothermographic materials can also include, on the backside of the support, one or more layers wherein at least one layer comprises an antihalation composition and/or a conductive material.

A method of this invention is a method of forming a visible image comprising:

A) imagewise exposing the thermally developable material of this invention that is a photothermographic material to electromagnetic radiation to form a latent image, and B) simultaneously or sequentially, heating the exposed photothermographic material to develop said latent image into a visible image.

This method can be extended wherein the photothermographic material has a transparent support to further comprise:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

Alternatively, if the thermally developable material of this invention is a thermographic material, a method of forming a visible image comprises:

A) imagewise applying thermal energy to the thermally developable material to form a visible image.

The visible image obtained using the present invention can be used for medical diagnosis.

It has been found that the particular barrier layer used in the present invention effectively inhibits (or retards) the diffusion of or reacts with fatty carboxylic acids (such as behenic acid) and other chemicals (such as hindered phenol developers and toners) that are present or formed in thermally developable imaging materials. Thus, the barrier layer reduces the buildup of debris on the processing equipment and improves imaging efficiencies and quality. The barrier layer can be the outermost layer and therefore also serve as a protective overcoat layer for the thermographic and photothermographic materials. Alternatively, the barrier layer can be interposed between the imaging layer(s) and a protective overcoat layer. Still again, a protective layer can be disposed between the barrier layer and the imaging layer(s).

These advantages are achieved by using certain metal hydroxides and carboxylates, and the resulting formulations are believed to provide excellent chemical and/or physical barriers to the fatty carboxylic acids and other mobile chemicals, such as phenolic developers and toners.

DETAILED DESCRIPTION OF THE INVENTION

The thermally developable materials of this invention include both thermographic and photothermographic materials. While the following discussion will often be directed to the preferred photothermographic embodiments, it would be readily understood by one skilled in the imaging arts that thermographic materials can be similarly constructed (using one or more imaging layers) and used to provide black-and-white or color images using non-photosensitive silver salts, reducing compositions, binders, and other components known to be used in such embodiments.

The thermographic and photothermographic materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these thermally developable materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermographic and photothermographic materials of this invention are particularly useful for medical imaging of human or animal subjects to provide black-and-white images.

The photothermographic materials of this invention can be made sensitive to radiation of any suitable wavelength. Thus, in some embodiments, the materials are sensitive at ultraviolet, visible, infrared, or near infrared wavelengths, of the electromagnetic spectrum. Increased sensitivity to a particular region of the spectrum is imparted through the use of various sensitizing dyes. In other embodiments, they are sensitive to X-radiation. Increased sensitivity to X-radiation is imparted through the use of phosphors.

The photothermographic materials of this invention are also useful for non-medical uses of visible or X-radiation (such as X-ray lithography and industrial radiography).

In the photothermographic materials of this invention, the components needed for imaging can be in one or more layers. The layer(s) that contain the photosensitive photocatalyst (such as a photosensitive silver halide) or the non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer.

Similarly, in the thermographic materials of this invention, the components needed for imaging can be in one or more layers. The layer(s) that contain the non-photosensitive source of reducible silver ions are referred herein as thermographic emulsion layer(s).

Where the materials contain imaging layers on one side of the support only, various non-imaging layers are usually disposed on the "backside" (non-emulsion or non-imaging side) of the materials, including antihalation layer(s), protective layers, antistatic layers, conductive layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some embodiments of photothermographic materials containing imaging layers on both sides of the support, such material can also include one or more protective topcoat layers, primer layers, interlayers, antistatic layers, acutance layers, antihalation layers, auxiliary layers, anti-crossover layers, and other layers readily apparent to one skilled in the art on either or both sides of the support.

When the thermographic and photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the thermographic and photothermographic materials of the present invention, "a" or "an" component refers to "at least one" of that component. For example, the metal hydroxides and carboxylates can be used individually or in combinations.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Thermographic material(s)" means a construction comprising at least one thermographic emulsion or imaging layer or a set of imaging layers (wherein the source of reducible silver ions is in one layer and the other essential components or desirable additives are distributed, as desired, in an adjacent coating layer) and any supports, topcoat layers, image-receiving layers, blocking layers, and subbing or priming layers. These materials also include multilayer constructions in which one or more imaging components are in different layers, but are in "reactive association" so that they readily come into contact with each other during thermal imaging and development. For example, one layer can include the non-photosensitive source of reducible silver ions and another layer can include the reducing composition, but the two reactive components are in reactive association with each other.

"Photothermographic material(s)" means a construction comprising at least one photothermographic emulsion layer or a photothermographic set of layers (wherein the photosensitive silver halide and the source of reducible silver ions are in one layer and the other essential components or desirable additives are distributed, as desired, in the same layer or in an adjacent coating layer) as well as any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads.

"Catalytic proximity" or "reactive association" means that the materials are in the same layer or in adjacent layers so that they readily come into contact with each other during thermal imaging and development.

"Emulsion layer," "imaging layer," "thermographic emulsion layer," or "photothermographic emulsion layer," means a layer of a thermographic or photothermographic material that contains the photosensitive silver halide (when used) and/or non-photosensitive source of reducible silver ions. It can also mean a layer of the thermographic or photothermographic material that contains, in addition to the photosensitive silver halide (when used) and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

Many of the materials used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms $D_{min}$ and $D_{max}$ have conventional definitions known in the imaging arts. In photothermographic materials, $D_{min}$ is considered herein as image density achieved when the photothermographic material is thermally developed without prior exposure to radiation. It is the average of eight lowest density values on the exposed side of the fiducial mark. In thermographic materials, $D_{min}$ is considered herein as image density in the non-thermally imaged areas of the thermographic material.

The sensitometric term "absorbance" is another term for optical density (OD).

"AC-1" (Average Contrast-1) is defined herein as the average contrast between an optical density of 0.6 above $D_{min}$ and an optical density of 2.0 above $D_{min}$.

Speed-2 ("SPD-2") is Log1/E+4 corresponding to the density value of 1.00 above $D_{min}$ where E is the exposure in ergs/cm$^2$.

"Transparent" means capable of transmitting visible light or imaging radiation without appreciable scattering or absorption.

Toners are compounds that when added to the photothermographic imaging layer shift the color of the developed silver image from yellowish-orange to dark brown-black or blue-black.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support.

In the compounds described herein, unless otherwise specified, no particular double bond geometry (for example, cis or trans) is intended by the structures drawn. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxy, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. In preferred embodiments, the silver halide comprises at least 70 mol % silver bromide with the remainder being silver chloride and silver iodide. More preferably, the amount of silver bromide is at least 90 mol %. Silver bromide and silver bromoiodide are more preferred silver halides, with the latter silver halide having up to 10 mol % silver iodide based on total silver halide. Typical techniques for preparing and precipitating silver halide grains are described in *Research Disclosure*, 1978, item 17643.

In some embodiments of aqueous-based photothermographic materials, higher amounts of iodide may be present in the photosensitive silver halide grains, and particularly from about 20 mol % up to the saturation limit of iodide, to increase image stability and to reduce "print-out," as described for example in U.S. Publication No. 2004/0053173 (Maskasky et al.).

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. For example, the central regions of the tabular grains may contain at least 1 mol % more iodide than the outer or annular regions of the grains. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference. Mixtures of preformed silver halide grains having different compositions or dopants grains may be employed.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process. The silver halide grains prepared ex-situ may then be added to and physically mixed with the non-photosensitive source of reducible silver ions.

In some formulations it is useful to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

In general, the non-tabular silver halide grains used in the imaging formulations can vary in average diameter of up to several micrometers ($\mu$m) depending on their desired use. Usually, the silver halide grains have an average particle size of from about 0.01 to about 1.5 $\mu$m. In some embodiments, the average particle size is preferable from about 0.03 to about 1.0 $\mu$m, and more preferably from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the doped photosensitive silver halide grains is expressed by the average diameter if the grains are spherical, and by the average of the diameters of equivalent circles for the projected images if the grains are cubic, tabular, or other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In further embodiments of this invention, the silver halide grains are tabular silver halide grains that are considered "ultrathin" and have an average thickness of at least 0.02 μm and up to and including 0.10 μm. Preferably, these ultrathin grains have an average thickness of at least 0.03 μm and more preferably of at least 0.04 μm, and up to and including 0.08 μm and more preferably up to and including 0.07 μm. In addition, these ultrathin tabular grains have an equivalent circular diameter (ECD) of at least 0.5 μm, preferably at least 0.75 μm, and more preferably at least 1 μm. The ECD can be up to and including 8 μm, preferably up to and including 6 μm, and more preferably up to and including 4 μm. The aspect ratio of the useful tabular grains is at least 5:1, preferably at least 10:1, and more preferably at least 15:1. For practical purposes, the tabular grain aspect is generally up to 50:1. The grain size of ultrathin tabular grains may be determined by any of the methods commonly employed in the art for particle size measurement, such as those described above. Ultrathin tabular grains having these properties are described in U.S. Pat. No. 6,576,410 (Zou et al.).

The ultrathin tabular silver halide grains can also be doped using one or more of the conventional metal dopants known for this purpose including those described in *Research Disclosure*, September 1996, item 38957 and U.S. Pat. No. 5,503,970 (Olm et al.), incorporated herein by reference. Preferred dopants include iridium (III or IV) and ruthenium (II or III) salts.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), JP Kokai 49-013224 A, (Fuji), JP Kokai 50-017216 A (Fuji), and JP Kokai 51-042529 A (Fuji).

Mixtures of both in-situ and ex-situ silver halide grains may be used.

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.) that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in photothermographic features of the invention may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and EP 0 915 371 A1 (Lok et al.).

In addition, mercaptotetrazoles and tetraazaindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature for a predetermined time. Various sulfur compounds can be used. Some examples of sulfur sensitizers include thiosulfates, thioureas, thioamides, thiazoles, rhodanines, phosphine sulfides, thiohydantoins, 4-oxo-oxazolidine-2-thiones, dipolysulfides, mercapto compounds, polythionates, and elemental sulfur.

Certain tetrasubstituted thiourea compounds are also useful in the present invention. Such compounds are described, for example in U.S. Pat. No. 6,296,998 (Eikenberry et al.), U.S. Pat. No. 6,322,961 (Lam et al.) and U.S. Pat. No. 6,368,779 (Lynch et al.). Also useful are the tetrasubstituted middle chalcogen (that is, sulfur, selenium, and tellurium) thiourea compounds disclosed in U.S. Pat. No. 4,810,626 (Burgmaier et al.). All of the above publications are incorporated herein by reference.

The amount of the sulfur sensitizer to be added varies depending upon various conditions such as pH, temperature and grain size of silver halide at the time of chemical ripening, it is preferably from $10^{-7}$ to $10^{-2}$ mole per mole of silver halide, and more preferably from $10^{-6}$ to $10^{-4}$ mole per mol of silver halide.

In one embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

Still other useful chemical sensitizers include certain selenium-containing compounds. When used, selenium sensitization is usually performed by adding a selenium sensitizer and stirring the emulsion at an appropriate temperature for a predetermined time. Some specific examples of useful selenium compounds can be found in U.S. Pat. No. 5,158,892 (Sasaki et al.), U.S. Pat. No. 5,238,807 (Sasaki et al.), U.S. Pat. No. 5,942,384 (Arai et al.) and U.S. Pat. No. 6,620,577 (Lynch et al.). All of the above documents are incorporated herein by reference.

Still other useful chemical sensitizers include certain tellurium-containing compounds. When used, tellurium sensitization is usually performed by adding a tellurium sensitizer and stirring the emulsion at an appropriate temperature for a predetermined time. Tellurium compounds for use as chemical sensitizers can be selected from those described in *J. Chem. Soc., Chem. Commun.* 1980, 635, ibid., 1979, 1102, ibid., 1979, 645, *J. Chem. Soc. Perkin. Trans*, 1980, 1, 2191, *The Chemistry of Organic Selenium and Tellurium Compounds*, S. Patai and Z. Rappoport, Eds., Vol. 1 (1986), and Vol. 2 (1987), U.S. Pat. No. 1,623,499 (Sheppard et al.), U.S. Pat. No. 3,320,069 (Illingsworth), U.S. Pat. No. 3,772,031 (Berry et al.), U.S. Pat. No. 5,215,880 (Kojima et al.), U.S. Pat. No. 5,273,874 (Kojima et al.), U.S. Pat. No. 5,342,750 (Sasaki et al.), U.S. Pat. No. 5,677,120 (Lushington et al.), British Patent 235,211 (Sheppard), British Patent 1,121,496 (Halwig), British Patent 1,295,462 (Hilson et al.) British Patent 1,396,696 (Simons), JP Kokai 04-271341 A (Morio et al.), in co-pending and commonly assigned U.S. Published Application 2002-0164549 (Lynch et al.), and in co-pending and commonly assigned U.S. Published Application 2003-0073026 (Gysling et al.). All of the above documents are incorporated herein by reference.

The amount of the selenium or tellurium sensitizer used in the present invention varies depending on silver halide grains used or chemical ripening conditions. However, it is generally from $10^{-8}$ to $10^{-2}$ mole per mole of silver halide, preferably on the order of from $10^{-7}$ to $10^{-3}$ mole of silver halide.

Noble metal sensitizers for use in the present invention include gold, platinum, palladium and iridium. Gold sensitization is particularly preferred.

When used, the gold sensitizer used for the gold sensitization of the silver halide emulsion used in the present invention may have an oxidation number of 1 or 3, and may be a gold compound commonly used as a gold sensitizer. U.S. Pat. No. 5,858,637 (Eshelman et al.) describes various Au (I) compounds that can be used as chemical sensitizers. Other useful gold compounds can be found in U.S. Pat. No. 5,759,761 (Lushington et al.). Useful combinations of gold (I) complexes and rapid sulfiding agents are described in U.S. Pat. No. 6,322,961 (Lam et al.). Combinations of gold (III) compounds and either sulfur- or tellurium-containing compounds are useful as chemical sensitizers and are described in U.S. Pat. No. 6,423,481 (Simpson et al.). All of the above references are incorporated herein by reference.

Reduction sensitization may also be used. Specific examples of compounds useful in reduction sensitization include, but are not limited to, stannous chloride, hydrazine ethanolamine, and thioureaoxide. Reduction sensitization may be performed by ripening the grains while keeping the emulsion at pH 7 or above, or at pAg 8.3 or less.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxandl dyes. Cyanine dyes, merocyanine dyes and complex merocyanine dyes are particularly useful. Spectral sensitizing dyes are chosen for optimum photosensitivity, stability, and synthetic ease. They may be added at any stage in chemical finishing of the photothermographic emulsion.

In some embodiments, the photosensitive silver halides are spectrally sensitized to a wavelength within the range of from about 300 to about 850 nm, and in other embodiments, they are spectrally sensitized to a wavelength within the range of from about 750 to about 1100 nm.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), and JP Kokai 2001-154305 (Kita et al.), can be used in the practice of the invention. All of the publications noted above are incorporated herein by reference. A summary of generally useful spectral sensitizing dyes is contained in *Research Disclosure*, December 1989, item 308119, Section IV. Additional classes of dyes useful for spectral sensitization, including sensitization at other wavelengths are described in *Research Disclosure*, 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. patent, U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat. Such dyes are described in U.S.

Pat. No. 4,524,128 (Edwards et al.), JP Kokai 2001-109101 (Adachi), JP Kokai 2001-154305 (Kita et al.), and JP Kokai 2001-183770 (Hanyu et al.).

Spectral sensitizing dyes may be used singly or in combination. The dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermographic and photothermographic materials of this invention can be any organic compound that contains reducible silver (1+) ions. Preferably, it is an organic silver salt that is comparatively stable to light and forms a silver image when heated to 50° C. or higher in the presence of an exposed photocatalyst (such as silver halide) and a reducing composition.

Silver salts of organic acids including silver salts of long-chain carboxylic acids are preferred. Examples thereof include silver salts of aliphatic carboxylic acids having 10 to 30, and preferably 15 to 28, carbon atoms. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative silver salts of aromatic carboxylic acids and other carboxylic acid group-containing compounds include, but are not limited to, silver benzoate, silver substituted-benzoates (such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

In some embodiments of this invention, a mixture of a silver salt of a compound having an imino group and a silver carboxylate can be used. Preferred examples of these compounds include, but are not limited to, silver salts of benzotriazole and substituted derivatives thereof (for example, silver methyl-benzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof.

Silver salts of sulfonates are also useful in the practice of this invention. Such materials are described for example in U.S. Pat. No. 4,504,575 (Lee). Silver salts of sulfosuccinates are also useful as described for example in EP 0 227 141 A1 (Leenders et al.).

Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielson et al.) and the references cited above.

Non-photosensitive sources of reducible silver ions can also be provided as core-shell silver salts such as those described in U.S. Pat. No. 6,355,408 (Whitcomb et al.) that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,472,131 (Whitcomb) that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter) that is incorporated herein by reference.

As one skilled in the art would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry thermographic and photothermographic material, and preferably from about 0.01 to about 0.05 $mol/m^2$ of that material.

The total amount of silver (from all silver sources) in the thermographic and photothermographic materials of this invention is generally at least 0.002 $mol/m^2$ and preferably from about 0.01 to about 0.05 $mol/m^2$.

Reducing Agents

When used in a thermographic or photothermographic material, the reducing agent (or reducing agent composition comprising two or more components) for the source of reducible silver ions can be any material, preferably an organic material, that can reduce silver (I) ion to metallic silver.

Conventional photographic developers can be used as reducing agents, including aromatic di- and tri-hydroxy compounds (such as hydroquinones, gallic acid and gallic acid derivatives, catechols, and pyrogallols), aminophenols (for example, N-methylaminophenol), sulfonamidophenols, p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When a silver carboxylate silver source is used in a photothermographic material, hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl) methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxy-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.) that is incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are reducing catechol-type reducing agents having no more than two hydroxy groups in an ortho-relationship. Preferred catechol-type reducing agents include, for example, catechol, 3-(3,4-dihydroxyphenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups that are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups that are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxy-benzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II).

Aromatic di- and tri-hydroxy reducing agents can also be used in combination with hindered phenol reducing agents either together or in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The use of "toners" or derivatives thereof that improve the image are highly desirable components of the thermographic and photothermographic materials of this invention. Toners are compounds that when added to the photothermographic imaging layer shift the color of the developed silver image from yellowish-orange to brown-black or blue-black, and/or act as development accelerators to speed up thermal development. They may also increase the optical density of the developed image. Without them, images are often faint and yellow or brown.

Thus, the thermally developable materials of this invention can also include one or more compounds that act either as toners or react with a reducing agent to provide toners in an amount of about 0.01% by weight to about 10%, and more preferably about 0.1% by weight to about 10% by weight, based on the total dry weight of the layer in which they are included. The amount can also be defined as being within the range of from about $1\times10^{-5}$ to about 1.0 mol per mole of non-photosensitive source of reducible silver in the thermographic or photothermographic material. The toner compounds may be incorporated in one or more of the thermally developable imaging layers as well as in adjacent layers such as a protective overcoat or underlying "carrier" layer. Toners can be located on both sides of the support if thermally developable imaging layers are present on both sides of the support.

Toners are well known materials in the thermographic and photothermographic art, as described, for example, in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (AGFA).

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and in U.S. Pat. Nos. 6,713,240 and 6,841,343 (Lynch et al.), as well as the triazine thione compounds described in U.S. Pat. No. 6,703,191 (Lynch et al.), and the heterocyclic disulfide compounds described in U.S. Pat. No. 6,737,227 (Lynch et al.). All of the above documents are incorporated herein by reference.

Phthalazine and phthalazine derivatives [such as those described in U.S. Pat. No. 6,146,822 (noted above), incorporated herein by reference], phthalazinone, and phthalazinone derivatives are particularly useful toners.

Other useful toners are the phthalazine compounds described in U.S. Pat. No. 6,605,418 (Ramsden et al.), incorporated herein by reference. These materials are believed to be particularly effective in accelerating image development.

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt(3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

The thermographic and photothermographic materials of the invention can also contain other additives such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused hetero-aromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants of this type are polyhalo antifoggants, such as those having a $—SO_2C(X')_3$ group wherein X' represents the same or different halogen atoms.

Another class of useful antifoggants includes those compounds described in U.S. Pat. No. 6,514,678 (Burgmaier et al.), incorporated herein by reference.

Advantageously, the thermographic and photothermographic materials of this invention may also include one or more thermal solvents (also called "heat solvents," "thermosolvents," "melt formers," "melt modifiers," "eutectic formers," "development modifiers," "waxes," or "plasticizers") for improving the reaction speed of the silver-developing redox reaction at elevated temperature.

By the term "thermal solvent" in this invention is meant an organic material that becomes a plasticizer or liquid solvent for at least one of the imaging layers upon heating at a temperature above 60° C. Useful for that purpose are polyethylene glycols having a mean molecular weight in the range of 1,500 to 20,000 described in U.S. Pat. No. 3,347,675 (Henn et al.). Also useful are compounds such as urea, methyl sulfonamide, and ethylene carbonate as described in U.S. Pat. No. 3,667,959 (Bojara et al.), and compounds such as tetrahydrothiophene-1,1-dioxide, methyl anisate, and 1,10-decanediol as described in *Research Disclosure*, December 1976, item 15027, pp. 26–28. Other representative examples of such compounds include, but are not limited to, niacinamide, hydantoin, 5,5-dimethylhydantoin, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea. Known thermal solvents are disclosed, for example, in U.S. Pat. No. 6,013,420 (Windender), U.S. Pat. No. 3,438,776 (Yudelson), U.S. Pat. No. 5,368,979 (Freedman et al.), U.S. Pat. No. 5,716,772 (Taguchi et al.), U.S. Pat. No. 5,250,386 (Aono et al.), and in *Research Disclosure*, December 1976, item 15022.

Phosphors

In some photothermographic embodiments, phosphors can be added to the imaging layers containing the photosensitive silver halide to increase photographic speed as described for example in U.S. Pat. No. 6,440,649 (Simpson et al.), incorporated herein by reference.

Phosphors are materials that emit infrared, visible, or ultraviolet radiation upon excitation. An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants "activate" the phosphor and cause it to emit infrared, visible, or ultraviolet radiation. For example, in $Gd_2O_2S$:Tb, the Tb atoms (the dopant/activator) give rise to the optical emission of the phosphor. Some phosphors, such as BaFBr, are known as storage phosphors. In these materials, the dopants are involved in the storage as well as the emission of radiation.

Any conventional or useful phosphor can be used, singly or in mixtures, in the imaging layers. For example, useful phosphors are described in numerous references relating to fluorescent intensifying screens, including but not limited to, *Research Disclosure*, August 1979, item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491 116A1 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Binders

The photocatalyst (such as the photosensitive silver halide), the non-photosensitive source of reducible silver ions, the reducing agent composition, toner(s), and any other additives used in the present invention are added to and coated in one or more binders using a suitable solvent. For example, organic solvent-based or aqueous-based formulations can be used to prepare the photothermographic materials of this invention. Mixtures of different types of hydrophilic and/or hydrophobic binders can also be used in these formulations.

Examples of useful hydrophilic binders include, but are not limited to, proteins and protein derivatives, gelatin and gelatin derivatives (hardened or unhardened, including alkali- and acid-treated gelatins, and deionized gelatin), cellulosic materials such as hydroxymethyl cellulose and cellulosic esters, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides (such as dextrans and starch ethers), and other naturally occurring or synthetic vehicles commonly known for use in aqueous-based photographic emulsions (see for example *Research Disclosure*, September 1996, item 38957, noted above). Cationic starches can also be used as peptizers for emulsions containing tabular grain silver halides as described in U.S. Pat. No. 5,620,840 (Maskasky) and U.S. Pat. No. 5,667,955 (Maskasky).

Particularly useful hydrophilic binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible polymer latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), U.S. Pat. No. 6,423,487 (Naoi), all of which are incorporated herein by reference.

Hardeners for various binders may be present if desired. Useful hardeners are well known and include diisocyanate compounds as described for example, in EP 0 600 586B1 (Philip, Jr. et al.) and vinyl sulfone compounds as described in U.S. Pat. No. 6,143,487 (Philip, Jr. et al.), and EP 0 640 589A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–78.

In some embodiments, the components needed for imaging can be added to one or more binders that are predominantly (at least 50% by weight of total binders) hydrophobic in nature. Thus, organic solvent-based formulations can be used to prepare the photothermographic materials of this invention. Mixtures of hydrophobic binders can also be used. It is preferred that at least 80% (by weight) of the binders be hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available as BUTVAR® B79 (Solutia, Inc.) and PIOLOFORM® BS-18, PIOLOFORM® BN-18, PIOLOFORM® BM-18, or PIOLOFORM® BL-16 (Wacker Chemical Company) and cellulose ester polymers.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range of binder amount can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The thermographic and photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Support materials may also be treated or annealed to reduce shrinkage and promote dimensional stability. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further possible to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in U.S. Pat. No. 6,630,283 (Simpson et al.) that is incorporated herein by reference.

Opaque supports such as dyed polymeric films and resin-coated papers that are stable to high temperatures can also be used.

Support materials can contain various colorants (such as blue dyes), pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Barrier Layer

The advantages of the present invention are achieved by using certain metal hydroxides and carboxylates in a barrier layer in the thermographic and photothermographic materials of the invention. The barrier layer is preferably the outermost layer on the "frontside" of those materials. A single homogeneous (that is, uniform throughout) barrier layer is preferred. However, as used herein, "barrier layer" also includes the use of multiple layers containing the same or different polymer composition disposed over the imaging and any other layers to provide a barrier "structure" or composite (having multiple strata) that serves as a physical and/or chemical barrier to the diffusion of the various chemical components (such as developers, toners, and fatty carboxylic acids as described below) that are present in the material or produced during thermal imaging and/or development.

In particular, the barrier layer is capable of retarding the diffusion of or reacting with fatty carboxylic acids, such as behenic acid and/or a hindered phenol developing agent.

The barrier layer can also act as the outermost surface protective overcoat layer or topcoat, but in some embodiments a protective overcoat layer is disposed over the barrier layer and underlying imaging layer(s). For example, protective overcoat layers comprising common overcoat binder materials such as poly(vinyl butyral), cellulose acetate butyrate, and other film-forming polymers can be disposed over the barrier layer.

In still other embodiments, a protective layer composed of poly(vinyl butyral), cellulose acetate butyrate, or other film-forming polymers can be interposed between the barrier layer and the one or more underlying imaging layers.

The barrier layer is generally transparent and colorless. If it is not transparent and colorless, it must be at least transparent to the wavelength of radiation used to provide and/or view the resulting image. Thus, the barrier layer does not significantly adversely affect the imaging properties of the thermographic and photothermographic materials of this invention, such as the sensitometric properties including minimum density, maximum density, and photospeed. That is, haze is desirably as low as possible.

The optimum barrier layer dry thickness depends upon various factors including the type of imaging material, thermal imaging and/or development means, desired image, and various imaging components. Generally, the one or more barrier layers have a total dry thickness of at least 0.2 $\mu$m, and preferably a total dry thickness of from about 1.5 $\mu$m to about 3 $\mu$m. The upper limit for the dry thickness is dependent only upon what is practical for meeting imaging needs. The one or more barrier layers in the thermally developable materials of this invention also have a general dry coverage of from about 0.1 to about 10 g/m$^2$, and preferably from about 1 to about 5 g/m$^2$. This weight includes all components of the barrier layer(s).

The barrier layer useful in this invention comprises as a scavenger, a water-insoluble compound having the following Structure I:

$$M(X)_n \qquad (I)$$

wherein M is a first row transition metal cation, including but not limited to zinc, nickel, manganese, or cobalt metal cations. Zinc and nickel compounds are most preferred.

X is a hydroxyl group, or an organic carboxylate having a molecular weight of from about 55 to about 500. Useful organic carboxylates having the requisite molecular weight include but are not limited to, aliphatic and aromatic carboxylates of carboxylic acids. Preferably, X is hydroxyl or an aliphatic carboxylate of an aliphatic carboxylic acid having 2 to 4 carbon atoms such as acetic acid, acrylic acid, methacrylic acid or an aromatic carboxylate such as a benzoate. More preferably, X is hydroxyl or an aliphatic carboxylate having a molecular weight from about 55 to about 200. Most preferably, X is a hydroxyl or an aliphatic carboxylate having a molecular weight from about 55 to about 125. Hydroxyl, acetate, and benzoate are particularly preferred.

Also in Structure I, n is an integer representing the positive charge on M.

The one or more scavenger are present in the barrier layer in an amount of from about 0.1 to about 1 mole per mole of total silver carboxylate(s) in the thermally developable material.

Examples of useful scavengers include but are not limited to zinc acetate, zinc hydroxide, zinc acrylate, zinc methacrylate, zinc benzoate, nickel acetate, manganese acetate, or mixtures thereof.

In general, the scavenger is dispersed in a binder in particulate form having an average particle size of 1 $\mu$m or less, and preferably having an average particle size of from about 1 nm to about 0.5 $\mu$m, and preferably from about 0.1 $\mu$m to to about 0.3 $\mu$m.

The barrier layer(s) can also include various addenda such as surfactants, lubricants, matting agents, crosslinking agents, photothermographic toners, acutance dyes and other chemicals that would be readily apparent to one skilled in the art, depending upon whether the barrier layer is on the outer surface or underneath another layer. These components can be present in conventional amounts.

The scavenger(s) and other addenda are generally dispersed within one or more binder materials such as hydrophobic binder polymers that are well known in the art. Any of the hydrophobic binder materials described above in the "Binder" section are useful. Polyvinyl acetals and cellulosic materials are preferred and poly(vinyl butyral) and cellulose acetate butyrate are most preferred as the binder materials.

The barrier layers can be applied to other layers in the thermographic or photothermographic materials using any suitable technique (see coating described below). Generally, the components of the layers are coated as a barrier layer formulation having predominantly (at least 50 weight %) one or more suitable polar organic solvents such as methyl ethyl ketone, acetone, tetrahydrofuran, methanol, or mixtures of any of these at from about 0.5% to about 35% solids, and then dried.

Alternatively, the barrier layers can be formulated in and coated as an aqueous formulation wherein water comprises at least 50 weight % of the total amount of solvents, and the rest of the solvents being one or more polar organic solvents as described above. Components of the layer(s) can be dissolved or dispersed within such coating formulations using known procedures.

Thermographic and Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic or water-dispersible polymer latex binder in water or water-organic solvent mixtures to provide aqueous-based coating formulations.

The thermally developable materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described therein.

The thermographic and photothermographic materials of this invention can include antistatic or conducting layers on either side of the support, and particularly on the backside (non-imaging side) of the support. Various conductive materials can be used in these layers. For example, such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776 A1 (Melpolder et al.). Particularly useful conductive particles are the non-acicular metal antimonate particles (such as zinc antimonite double oxide particles) as described in U.S. Pat. No. 6,689,546 (LaBelle et al.). All of the above patents and patent applications are incorporated herein by reference. Other antistatic agents are well known in the art.

Other conductive compositions include one or more fluoro-chemicals each of which is a reaction product of $R_f—CH_2CH_2—SO_3H$ with an amine wherein $R_f$ comprises 4 or more fully fluorinated carbon atoms. These antistatic compositions are described in more detail in copending and commonly assigned U.S. Published Application 2003-0198901 (Sakizadeh et al.) that is incorporated herein by reference.

Additional conductive compositions include one or more fluoro-chemicals having the structure $R_f—R—N(R'_1)(R'_2)(R'_3)^+X^-$ wherein $R_f$ is a straight or branched chain perfluoroalkyl group having 4 to 18 carbon atoms, R is a divalent linking group comprising at least 4 carbon atoms and a sulfide group in the chain, $R'_1$, $R'_2$, $R'_3$ are independently hydrogen or alkyl groups or any two of $R'_1$, $R'_2$, and $R'_3$ taken together can represent the carbon and nitrogen atoms necessary to provide a 5- to 7-membered heterocyclic ring with the cationic nitrogen atom, and $X^-$ is a monovalent anion. These antistatic compositions are described in more detail in U.S. Pat. No. 6,689,546 (Sakizadeh et al.) that is incorporated herein by reference.

The thermographic and photothermographic materials of this invention can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants on the imaging side of the support, and a binder and various non-imaging components on the backside of the support.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

For double-sided photothermographic materials, each side of the support can include one or more of the same or different imaging layers, interlayers, and protective topcoat layers. In such materials preferably a topcoat is present as the outermost layer on both sides of the support. The thermally developable layers on opposite sides can have the same or different construction and can be overcoated with the same or different protective layers.

Layers to promote adhesion of one layer to another in thermographic and photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Thermographic and photothermographic formulations (and barrier layer formulations) described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different.

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), an imaging layer, a protective topcoat layer, or a combination of such layers.

It is also contemplated that the photothermographic materials of this invention can include thermally developable imaging (or emulsion) layers on both sides of the support and at least one heat-bleachable composition in an antihalation underlayer beneath layers on one or both sides of the support.

Photothermographic materials having thermally developable layers disposed on both sides of the support often suffer from "crossover." Crossover results when radiation used to image one side of the photothermographic material is transmitted through the support and images the photothermographic layers on the opposite side of the support. Such radiation causes a lowering of image quality (especially sharpness). As crossover is reduced, the sharper becomes the image. Various methods are available for reducing crossover. Such "anti-crossover" materials can be materials specifically included for reducing crossover or they can be acutance or antihalation dyes. In either situation, when used with visible radiation it is often necessary that they be rendered colorless during processing.

To promote image sharpness, photothermographic materials according to the present invention can contain one or more layers containing acutance, filter, crossover prevention (anti-crossover), anti-irradiation and/or antihalation dyes. These dyes are chosen to have absorption close to the exposure wavelength and are designed to absorb non-absorbed or scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more layers such as a thermally developable imaging layer, primer layer, underlayer, or topcoat layer (particularly on the frontside) according to known techniques.

Dyes useful as antihalation, filter, crossover prevention (anti-crossover), anti-irradiation and/or acutance dyes include squaraine dyes described in U.S. Pat. No. 5,380,635 (Gomez et al.), U.S. Pat. No. 6,063,560 (Suzuki et al.), U.S. Pat. No. 6,432,340 (Tanaka et al.), U.S. Pat. No. 6,444,415 (Tanaka et al.), and EP 1 083 459 A1 (Kimura), the indolenine dyes described in EP 0 342 810 A1 (Leichter), and the cyanine dyes described in copending and commonly assigned U.S. Published Application 2003-0162134 (Hunt et al.). All of the above references are incorporated herein by reference.

It is also useful in the present invention to employ compositions including acutance, filter, crossover prevention (anti-crossover), anti-irradiation and/or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP Kokai 2001-142175 (Hanyu et al.), and JP 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), JP Kokai 2001-22027 (Adachi), JP Kokai 2000-029168 (Noro), and U.S. Pat. No. 6,376,163 (Goswami, et al.). All of the above references are incorporated herein by reference.

Particularly useful heat-bleachable acutance, filter, crossover prevention (anti-crossover), anti-irradiation and/or antihalation compositions include a radiation absorbing compound used in combination with a hexaaryl-biimidazole (also known as a "HABI"). Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,558,880 (Goswami et al.) and U.S. Pat. No. 6,514,677 (Ramsden et al.), both incorporated herein by reference.

Under practical conditions of use, the compositions are heated to provide bleaching at a temperature of at least 90° C. for at least 0.5 seconds.

In preferred embodiments, the photothermographic materials of this invention include a surface protective layer on the same side of the support as the one or more photothermographic emulsion layers and a layer on the backside that includes an antihalation composition and/or conductive antistatic materials. A separate backside surface protective layer can also be included in these embodiments. At least one of these backside layers can also contain a backside stabilizer compound.

Imaging/Development

The thermally developable materials of the present invention can be imaged in any suitable manner consistent with the type of material using any suitable imaging source (typically some type of radiation or electronic signal for photothermographic materials and a source of thermal energy for thermographic materials).

In some embodiments, the materials contain silver halide(s) that are sensitive to radiation in the range of from about at least 300 nm to about 1400 nm, for example from about 300 nm to about 850 nm. In preferred embodiments, the materials contain silver halide(s) that are sensitive to radiation of from about 750 to about 1150 nm. Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The materials can be made sensitive to X-radiation or radiation in the ultraviolet region of the spectrum, the visible region of the spectrum, or the infrared region of the electromagnetic spectrum. Useful X-radiation imaging sources include general medical, mammographic, dental, industrial X-ray units, and other X-radiation generating equipment known to one skilled in the art.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

When imaging thermographic materials of this invention, the image may be "written" simultaneously with development at a suitable temperature using a thermal stylus, a thermal print-head, or a laser, or by heating while in contact with a heat-absorbing material. The thermographic materials may include a dye (such as an IR-absorbing dye) to facilitate direct development by exposure to laser radiation. The dye converts absorbed radiation to heat.

Use as a Photomask

The thermographic and photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the thermographic or photothermographic material and subsequent development affords a visible image.

Where the thermographic or photothermographic material comprises a transparent support, the visible image prepared from the imaged material can also be used as a mask for exposure of other photosensitive imageable materials. The heat-developed material may then be positioned between a source of imaging radiation (such as an ultraviolet or short wavelength visible radiation energy source) and an imageable material that is sensitive to such imaging radiation, such as photopolymers, photoresists, graphic arts films, proofing films, photosensitive printing plates, diazo materials, and circuit board films. The heat-developed thermographic or photothermographic material absorbs ultraviolet or short wavelength visible radiation in the areas where there is a visible image and transmits ultraviolet or short wavelength visible radiation where there is no visible image. Thus, exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

Imaging Assemblies

To further increase photospeed, the X-radiation sensitive photothermographic materials of this invention may be used in association with one or more phosphor intensifying screens and/or metal screens in what is known as "imaging assemblies." An intensifying screen absorbs X-radiation and emits longer wavelength electromagnetic radiation that the photosensitive silver halide more readily absorbs. Double-coated X-radiation sensitive photothermographic materials (that is, materials having one or more thermally developable imaging layers on both sides of the support) are preferably used in combination with two intensifying screens, one screen in the "front" and one screen in the "back" of the material.

The imaging assemblies of the present invention are composed of a photothermographic material as defined herein (particularly one sensitive to X-radiation or visible light) and one or more phosphor intensifying screens adjacent the front and/or back of the material. The screens are typically designed to absorb X-rays and to emit electromagnetic radiation having a wavelength greater than 300 nm.

There are a wide variety of phosphors known in the art that can be formulated into phosphor intensifying screens, including but not limited to, the phosphors described in *Research Disclosure*, Vol. 184, August 1979, item 18431, Section IX, X-ray Screens/Phosphors, (noted above), hafnium containing phosphors (noted above), as well as those described in U.S. Pat. No. 4,835,397 (Arakawa et al.), U.S. Pat. No. 5,381,015 (Dooms), U.S. Pat. No. 5,464,568 (Bringley et al.), U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), U.S. Pat. No. 4,368,390 (Takahashi et al.), U.S. Pat. No. 5,227,253 (Takasu et al.), the disclosures of which are all incorporated herein by reference for their teaching of phosphors and formulation of phosphor intensifying screens.

Phosphor intensifying screens can take any convenient form providing they meet all of the usual requirements for use in radiographic imaging, as described for example in U.S. Pat. No. 5,021,327 (Bunch et al.), incorporated herein by reference. A variety of such screens are commercially available from several sources including but not limited to, LANEX®, X-SIGHT® and INSIGHT® Skeletal screens all available from Eastman Kodak Company. The front and back screens can be appropriately chosen depending upon the type of emissions desired, the desired photicity, emulsion speeds, and % crossover. A metal (such as copper or lead) screen can also be included if desired.

Imaging assemblies can be prepared by arranging a suitable photothermographic material in association with one or more phosphor intensifying screens, and one or more metal screens in a suitable holder (often known as a cassette), and appropriately packaging them for transport and imaging uses.

Constructions and assemblies useful in industrial radiography include, for example, U.S. Pat. No. 4,480,024 (Lyons et al), U.S. Pat. No. 5,900,357 (Feumi-Jantou et al.), and EP 1 350 883 A1 (Pesce et al.).

MATERIALS AND METHODS FOR THE EXAMPLES

All materials used in the following examples are readily available from standard commercial sources, such as Aldrich Chemical Co. (Milwaukee, Wis.), Alfa Aesar (Ward Hill, Mass.), or Pfaltz and Bauer Inc. (Waterbury, Conn.), unless otherwise specified. All percentages are by weight unless otherwise indicated. The following additional terms and materials were used.

ACRYLOID® A-21 or PARALOID® A-21 is an acrylic copolymer available from Rohm and Haas (Philadelphia, Pa.).

CAB 171-15S and CAB 381-20 are cellulose acetate butyrate resins available from Eastman Chemical Co. (Kingsport, Tenn.).

CBBA is 2-(4-chlorobenzoyl)benzoic acid.

DESMODUR® N3300 is an aliphatic hexamethylene diisocyanate available from Bayer Chemicals (Pittsburgh, Pa.).

LOWINOX® 221B446 is 2,2'-isobutylidene-bis(4,6-dimethylphenol) available from Great Lakes Chemical (West Lafayette, Ind.).

MEK is methyl ethyl ketone (or 2-butanone).

"PHP" is pyridinium hydrobromide perbromide.

PIOLOFORM® BS-18 and BL-16 are polyvinyl butyral resins available from Wacker Polymer Systems (Adrian, Mich.).

Vinyl Sulfone-1 (VS-1) is described in U.S. Pat. No. 6,143,487 and has the structure shown below.

(VS-1)

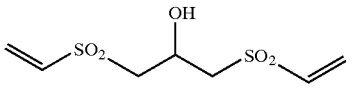

Ethyl-2-cyano-3-oxobutanoate has the structure shown below.

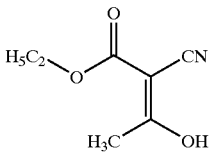

2-(Tribromomethylsulfonyl)quinoline is antifoggant A (AF-A) and has the structure shown below.

(AF-A)

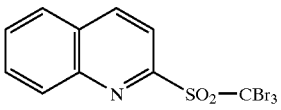

Sensitizing Dye A (SD-A) is benzothiazolium, 3-ethyl-2-[[7-[[3-ethyl-5-(methylthio)-2(3H)-benzothiazolylidene]-methyl]-4,4a,5,6-tetrahydro-2(3H)-naphthalenylidene]methyl]-5-(methylthio)-, iodide. It is is described in U.S. Pat. No. 5,541,054 (Miller et al.) and has the structure shown below.

(SD-A)

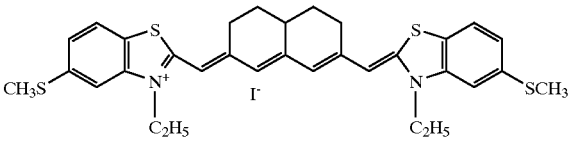

Antihalation Dye AH-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

(AH-1BC-1)

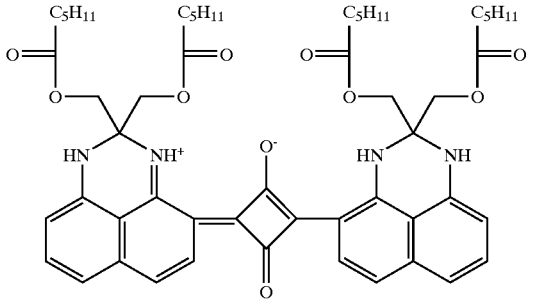

Preparation of Photothermographic Emulsion:

A preformed iridium and copper doped core-shell silver iodobromide emulsion was prepared as described in U.S. Pat. No. 5,939,249 (noted above) and incorporated herein by reference.

A photothermographic emulsion of silver carboxylate full soap containing preformed silver halide grains as above was prepared also as described in U.S. Pat. No. 5,939,249, noted above.

Preparation of Photothermographic Coating Formulation:

An emulsion of silver carboxylate full soap containing preformed silver halide grains prepared above, was homogenized to 28.1% solids in MEK containing PIOLOFORM® BS-18 polyvinyl butyral binder (4.4% solids). To 192 parts of this emulsion were added 1.6 parts of a 15% solution of pyridinium hydrobromide perbromide in methanol with stirring. After 60 minutes of mixing, 2.1 parts of an 11% zinc bromide solution in methanol were added. Stirring was continued, and after 30 minutes an addition to was made of a solution of 0.15 parts 2-mercapto-5-methylbenzimidazole, 0.007 parts Sensitizing Dye A, 1.7 parts of 2-(4-chlorobenzoyl)benzoic acid, 10.8 parts of methanol, and 3.8 parts of MEK.

After stirring for another 75 minutes, 41 parts of PIOLOFORM® BL-16 were added and the temperature was reduced to 10° C., and mixing was continued for another 30 minutes.

At this time, the photothermographic imaging formulation was completed by adding Solution A, LOWINOX™, Solution B, and Solution C. These materials were added 5 minutes apart. Mixing was maintained.

| | |
|---|---|
| Solution A: | |
| Antifoggant A (AF-A) | 1.3 parts |
| Tetrachlorophthalic acid | 0.37 parts |
| 4-Methylphthalic acid | 0.60 parts |
| MEK | 20.6 parts |
| Methanol | 0.36 parts |
| LOWINOX ™ 221B446 | 9.5 parts |
| Solution B: | |
| DESMODUR ™ N3300 | 0.66 parts |
| MEK | 0.33 parts |
| Solution C: | |
| Phthalazine | 1.3 parts |
| MEK | 6.3 parts |

Examples 1–6 and Comparative Example C-1

The following examples demonstrate the use of various metal hydroxides and metal esters to reduce the amount of fatty carboxylic acid and reducing agent, and toner released from photothermographic materials during development.

A 7 mil (177.8 μm) transparent blue-tinted poly(ethylene terephthalate) support was coated on one side with an antihalation layer containing antihalation dye AH-1 in cellulose acetate butyrate (CAB 381-20) to provide a construction having an absorbance greater than 0.3 between 805 and 815 nm. This layer also contained antistatic and surface roughness materials to make the film easy to image and develop in imaging machines. A conventional automated knife coating machine was used.

A topcoat barrier layer stock formulation was prepared by dissolving 0.76 parts of ACRYLOID™ A-21, 19.7 parts of CAB 171-15S, 0.57 parts of vinyl sulfone (VS-1), 0.43 parts of benzotriazole, 0.38 parts of ethyl-2-cyano-3-oxobutanoate, and 0.41 of parts antihalation dye AH-1 in 288 parts of MEK.

Each metal hydroxide (0.0038 mol) or metal ester (0.0038 mol) was added to 26 g of the above topcoat stock solution to form a topcoat barrier layer formulation.

A comparative topcoat formulation, Comparative Example C-1, was similarly prepared using the topcoat stock solution prepared above but with no metal ester or metal hydroxide added to scavenge the fatty acid or toner emissions.

Imaging materials were prepared by simultaneously coating a portion of the photothermographic formulation and each topcoat barrier layer formulation onto the side of the support opposite the antihalation layer using a conventional automated dual knife coating machine. Safelight conditions were used during the coating. All materials were dried at 185° F. (85° C.) for 4 minutes. The imaging layer was coated at a silver coverage of 2 g/m$^2$. Each topcoat barrier layer was coated at a dry coverage of 1.9 g/m$^2$.

All of the photothermographic materials were then completely imaged by uniform exposure to strong white light. Each sample was then covered with a 0.5 mil (12.5 μm) poly(ethylene terephthalate) receptor sheet coated with cellulose acetate and silica. The receptor coatings faced the topcoat layer (that is, the outermost layer) of the photothermographic material. A sheet of 1 mil (25.4 μm) poly(ethylene terephthalate) film was placed over the receptor sheet for protection. Each material/receptor/protecting sheet construction was developed to maximum density ($D_{max}$) on a heated rotating drum processor for 20 seconds at 121° C. The protecting and receptor sheets were separated from each photothermographic material. The receptor sheets were cut into strips, inserted in a vial, and any reducing agent, fatty carboxylic acids, and other materials transferred from the photothermographic material to the receptor sheet during development were extracted using a mixture of toluene and isopropyl alcohol. The amount of extracted materials was determined using gas chromatography.

The results, shown below in TABLE I, demonstrate the effectiveness of the use of various metal hydroxides or metal esters in topcoat layers in reducing the amount of reducing agent and fatty carboxylic acid released from photothermographic materials during development.

TABLE I

| Example | Metal Hydroxide or Metal Ester Added | % Reduction in Total Emissions | % Reduction in Reducing Agent | % Reduction in Fatty Acid | Comments |
|---|---|---|---|---|---|
| C-1 | None | — | — | — | Comparison |
| 1 | Zinc Hydroxide | 42.4% | 50.5% | 56.9% | Invention |
| 2 | Manganese (III) Acetate | 42.4% | 0% | 77.3% | Invention |
| 3 | Manganese (II) Acetate | 24.1% | 0% | 73.0% | Invention |
| 4 | Nickel (II) Acetate | 32.1% | 41.0% | 49.5% | Invention |
| 5 | Zinc Acetate | 43.2% | 2.5% | 34.4% | Invention |
| 6 | Cobalt (II) Acetate | 12.7% | 0% | 52.2% | Invention |

Examples 7–13 and Comparative Example C-2

The following examples demonstrate the use of zinc acrylate to reduce the amount of fatty carboxylic acid and toner released from photothermographic materials during development.

A 7 mil (177.8 μm) transparent blue-tinted poly(ethylene terephthalate) support was coated on one side with an antihalation layer containing antihalation dye AH-1 in cellulose acetate butyrate (CAB 381-20) to provide a construction having an absorbance greater than 0.3 between 805 and 815 nm. This layer also contained antistatic and surface roughness materials to make the film easy to image and develop in imaging machines. A conventional automated knife coating machine was used.

A photothermographic coating formulation was prepared as described above.

A topcoat barrier layer formulation was prepared by dissolving 0.26 parts of ACRYLOID® A-21, 6.6 parts of CAB 171-15S, 0.19 parts of vinyl sulfone (VS-1), 0.14 parts of benzotriazole, 0.127 parts of ethyl-2-cyano-3-oxobutanoate, the indicated amount of zinc methacrylate, and 0.113 parts of antihalation dye AH-1 in 92.5 parts of MEK.

A comparative topcoat formulation, Comparative Example C-2, was similarly prepared using the topcoat stock solution prepared above but with no zinc methacrylate added.

Imaging materials were prepared by simultaneously coating a portion of the photothermographic formulation and each topcoat barrier layer formulation onto the side of the support opposite the antihalation layer using a conventional automated dual knife coating machine. Safelight conditions were used during the coating. All materials were dried at 185° F. (85° C.) for 4 minutes. The imaging layer was coated at a silver coverage of 2 g/m$^2$. The topcoat barrier layer was coated at a dry coverage of 2.7 g/m$^2$.

All of the photothermographic materials were then completely imaged by uniform exposure to strong white light. Each sample was then covered with a 0.5 mil (12.5 $\mu$m) poly(ethylene terephthalate) receptor sheet coated with cellulose acetate and silica. The receptor coatings faced the topcoat layer (that is, the outermost layer) of the photothermographic material. A sheet of 1 mil (25.4 $\mu$m) poly(ethylene terephthalate) film was placed over the receptor sheet for protection. Each material/receptor/protecting sheet construction was developed to maximum density ($D_{max}$) on a heated rotating drum processor for 20 seconds at 121° C. The protecting and receptor sheets were separated from each photothermographic material. The receptor sheets were cut into strips, inserted in a vial, and any reducing agent, fatty carboxylic acids, and other materials transferred from the photothermographic material to the receptor sheet during development were extracted using a mixture of toluene and isopropyl alcohol. The amount of extracted materials was determined using gas chromatography.

The results, shown below in TABLE II demonstrate the effectiveness of the use of metal esters such as zinc methacrylate in topcoat barrier layers to reduce the amount of fatty carboxylic acid and toners released from photothermographic materials during development.

TABLE II

| Example | Amount of Zinc Methacrylate added to 100 g of topcoat | Ratio of Total Resins to Zinc Methacrylate | % Reduction in Fatty Acid | % Reduction in Phthalazine | Comments |
|---|---|---|---|---|---|
| C-2 | None | 100:0 | — | — | Comparison |
| 7 | 0.7 | 91:09 | 31.3 | 12.7 | Invention |
| 8 | 0.8 | 89:11 | 29.4 | 16.5 | Invention |
| 9 | 1.0 | 87:13 | 37.7 | 21.1 | Invention |
| 10 | 1.2 | 85:15 | 35.5 | 17.3 | Invention |
| 11 | 1.6 | 80:20 | 54.4 | 30.1 | Invention |
| 12 | 2.5 | 73:27 | 80.7 | 43.6 | Invention |
| 13 | 3.3 | 66:34 | 92.5 | 53.0 | Invention |

Example 14

The following example demonstrates that metal hydroxides and metal esters within the present invention can be incorporated in topcoat barrier layers of thermographic materials.

A 20 cm×1 cm strip of unexposed photothermographic material prepared as described in Example 5 above, was heated on a Reichert Heizbank heating block system (Kofler Reichert, Austria) with a temperature gradient from 68° C. to 212° C. for 15 seconds. Heating was carried out under IR safelight conditions. The density of imaged strips was measured on a MacBeth Model TR 924 Densitometer equipped with a visible filter. An optical density greater than 3.7 was obtained at a temperature of 165° C., while the optical density remained below 0.23 at temperatures below 110° C. This demonstration of the use of an unexposed photothermographic material is comparable to the use of a non-photosensitive thermographic material.

Thus, thermographic materials incorporating metal hydroxides and metal esters within the present invention are capable of forming thermographic materials with excellent $D_{min}$ and $D_{max}$.

The invention has been described in detail with particular reference to certain preferred embodiments thereof, but it will be understood that variations and modifications can be effected within the spirit and scope of the invention.

We claim:

1. A black-and-white thermally developable material comprising a support having thereon:

a) one or more thermally developable imaging layers comprising a binder and in reactive association, a non-photosensitive source of reducible silver ions that includes at least a silver carboxylate, and a reducing agent composition for said non-photosensitive source of reducible silver ions, said binder comprising from 0 to less than 50% of a polymer latex based on total binder weight, and b) a barrier layer that is on the same side of but farther from said support than said one or more imaging layers, said barrier layer coated predominantly from one or more polar organic solvents and containing as a scavenger dispersed in a hydrophobic binder, a water-insoluble compound having the following Structure I:

$$M(X)_n \quad (I)$$

wherein M is a first row transition metal cation, X is a hydroxyl group, or an organic carboxylate having a molecular weight of from about 55 to about 500, and n is an integer representing the positive charge on M, wherein the amount of said scavenger being from about 0.4 to about 1 mole per mole of said silver carboxylate.

2. The thermally developable material of claim 1 wherein M is a zinc, nickel, manganese, or cobalt metal ion, X is hydroxyl or an aliphatic carboxylate having 2 to 4 carbon atoms or an aromatic carboxylate.

3. The thermally developable material of claim 2 wherein M is a zinc or nickel metal, X is an aliphatic carboxylate.

4. The thermally developable material of claim 1 wherein said scavenger is zinc acetate, zinc hydroxide, zinc acrylate, zinc methacrylate, zinc benzoate, nickel acetate, manganese acetate, or mixtures thereof.

5. The thermally developable material of claim 1 wherein said scavenger is dispersed in said hydrophobic binder in particulate form having an average particle size of 1 $\mu$m or less.

6. The thermally developable material of claim 1 wherein said scavenger is dispersed in said hydrophobic binder in particulate form having an average particle size of from about 1 nm to about 0.5 μm.

7. The thermally developable material of claim 1 wherein said barrier layer is the outermost layer on the imaging side that also acts as a protective topcoat.

8. The thermally developable material of claim 1 further comprising a protective layer that is disposed between said barrier layer and said one or more imaging layers.

9. The thermally developable material of claim 1 further comprising an outermost protective overcoat layer, and said barrier layer is disposed between said outermost protective overcoat layer and said one or more imaging layers.

10. The thermally developable material of claim 1 wherein said non-photosensitive source of reducible silver ions comprises a silver fatty acid carboxylate having 10 to 30 carbon atoms in the fatty acid or a mixture of said silver fatty acid carboxylates, at least one of which is silver behenate.

11. The thermally developable material of claim 10 further comprising a co-developer.

12. The thermally developable material of claim 11 further comprising a contrast enhancing agent.

13. The thermally developable material of claim 1 wherein said baffler layer further comprises a surfactant, lubricant, matting agent, adhesion promoter, stabilizer, or acutance dye.

14. The thermally developable material of claim 1 that is a photothermographic material further comprising a silver halide or mixture of silver halides as a photocatalyst.

15. The thermally developable material of claim 1 that is a photothermographic material containing a silver halide that is sensitive to radiation of from about 300 to about 850 nm.

16. The thermally developable material of claim 1 that is a photothermographic material containing a silver halide that is sensitive to radiation of from about 750 to about 1150 nm.

17. The thermally developable material of claim 1 wherein said baffler layer is capable of retarding the diffusion of or reacting with fatty carboxylic acids.

18. The thermally developable material of claim 1 wherein said baffler layer is capable of retarding the diffusion of or is reactive with behenic acid and/or a hindered phenol developing agent.

19. The thermally developable material of claim 1 wherein said baffler layer is present at a dry thickness of from about 1.5 μm to about 3 μm.

20. The thermally developable material of claim 1 further comprising a phthalazine toner.

21. A black-and-white photothermographic material comprising a support having thereon:

a) one or more thermally developable imaging layers comprising a binder and in reactive association, a photosensitive silver halide, a non-photosensitive source of reducible silver ions that includes at least a silver carboxylate, and a reducing agent composition for said non-photosensitive source of reducible silver ions, said binder comprising from 0 to less than 50% of a polymer latex based on total binder weight, and b) a barrier layer that is on the same side of but farther from said support than said one or more imaging layers, said barrier layer coated predominantly from one or more polar organic solvents and containing as a scavenger dispersed in a hydrophobic binder, a water-insoluble compound having the following Structure I:

$$M(X)_n \qquad (I)$$

wherein M is a first row transition metal cation, X is a hydroxyl group, or an organic carboxylate having a molecular weight of from about 55 to about 500, and n is an integer representing the positive charge on M, wherein the amount of said scavenger being from about 0.4 to about 1 mole per mole of said silver carboxylate.

22. A black-and-white photothermographic material comprising a support having thereon:

a) one or more thermally developable imaging layers comprising a hydrophobic binder and in reactive association, a photosensitive preformed silver halide that is a silver bromide, silver iodobromide having up to 10 mol % silver iodide, or mixtures of these silver halides, a non-photosensitive source of reducible silver ions comprising one or more silver fatty acid carboxylates that include silver behenate, and a reducing agent composition for said non-photosensitive source reducible silver ions comprising a hindered phenol, said binder comprising from 0 to less than 50% of a polymer latex based on total binder weight, and b) a barrier layer that is on the same side of but farther from said support than said one or more imaging layers, said barrier layer comprising a scavenger that is zinc acetate, zinc hydroxide, zinc acrylate, zinc methacrylate, zinc benzoate, nickel acetate, manganese acetate, or mixtures thereof, said scavenger present in an amount of from about 0.4 to about 0.6 mole per mole of said one or more silver fatty acid carboxylates, and said barrier layer having a dry thickness of from about 1.5 μm to about 3 μm.

23. The black-and-white photothermographic material of claim 22 further comprising:

c) on the backside of said support, one or more layers wherein at least one layer comprises an antihalation composition and/or a conductive material.

24. The black-and-white photothermographic material of claim 22 further comprising one or more additional thermally developable imaging layers on both sides of said support.

25. A method of forming a visible image comprising:

A) imagewise exposing the thermally developable material of claim 1 that is a photothermographic material to electromagnetic radiation to form a latent image, and B) simultaneously or sequentially, heating said exposed photothermographic material to develop said latent image into a visible image.

26. The method of claim 25 wherein said photothermographic material has a transparent support and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

27. A method of forming a visible image comprising:

A) imagewise applying thermal energy to the thermally developable material of claim 1 that is a thermographic material to form a visible image.

28. The method of claim 25 wherein said visible image is used for medical diagnosis.

* * * * *